US006444118B1

(12) United States Patent
Podrebarac et al.

(10) Patent No.: US 6,444,118 B1
(45) Date of Patent: Sep. 3, 2002

(54) PROCESS FOR SULFUR REDUCTION IN NAPHTHA STREAMS

(75) Inventors: Gary G. Podrebarac; Gary R. Gildert, both of Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 62 days.

(21) Appl. No.: 09/785,909

(22) Filed: Feb. 16, 2001

(51) Int. Cl.[7] ..... C10G 45/00; C10G 65/04

(52) U.S. Cl. ..... 208/210; 208/209; 208/208 R; 208/211; 208/213; 208/218; 208/143; 585/259; 585/260; 585/264; 203/DIG. 6

(58) Field of Search ..... 208/208 R, 209, 208/210, 211, 213, 218, 143; 585/259, 260, 264; 203/DIG. 6

(56) References Cited

U.S. PATENT DOCUMENTS

| | | | |
|---|---|---|---|
| 5,320,742 | A | 6/1994 | Fletcher et al. |
| 5,510,089 | A | 4/1996 | Jones |
| 5,597,476 | A | 1/1997 | Hearn et al. |
| 5,779,883 | A | 7/1998 | Hearn et al. |
| 5,807,477 | A | 9/1998 | Hearn et al. |
| 6,083,378 | A | 7/2000 | Gildert et al. |
| 6,303,020 | B1 * | 10/2001 | Podrebarac et al. |

..... 208/210

* cited by examiner

*Primary Examiner*—Walter D. Griffin
*Assistant Examiner*—Tam M. Nguyen
(74) *Attorney, Agent, or Firm*—Kenneth H. Johnson

(57) ABSTRACT

A process for concurrently fractionating and treating of a full range naphtha stream. The full boiling range naphtha stream is first subjected to simultaneous thioetherification or selective hydrogenation and splitting into a light boiling range naphtha, an intermediate boiling range naphtha and a heavy boiling range naphtha. The intermediate boiling range naphtha containing thiophene and thiophene boiling range mercaptans, dienes or mixtures may be subjected to a second thioetherification or selective hydrogenation, depending on its make-up, and then passed on to a polishing hydrodesulfurization reactor or the entire intermediate stream may be passed directly to the polishing reactor. The bottoms are subjected to concurrent hydrodesulfurization and fractional distillation and the combined overheads and bottoms are fed to the polishing reactor. The effluent from the polishing reactor may be combined with the light boiling range naphtha to produce a new full boiling range naphtha containing substantially less total sulfur than the original feed. The object being to meet higher standards for sulfur removal, by treating the components of the naphtha feed with the process that preserves the olefinic while most expediently removing the sulfur compounds.

18 Claims, 1 Drawing Sheet

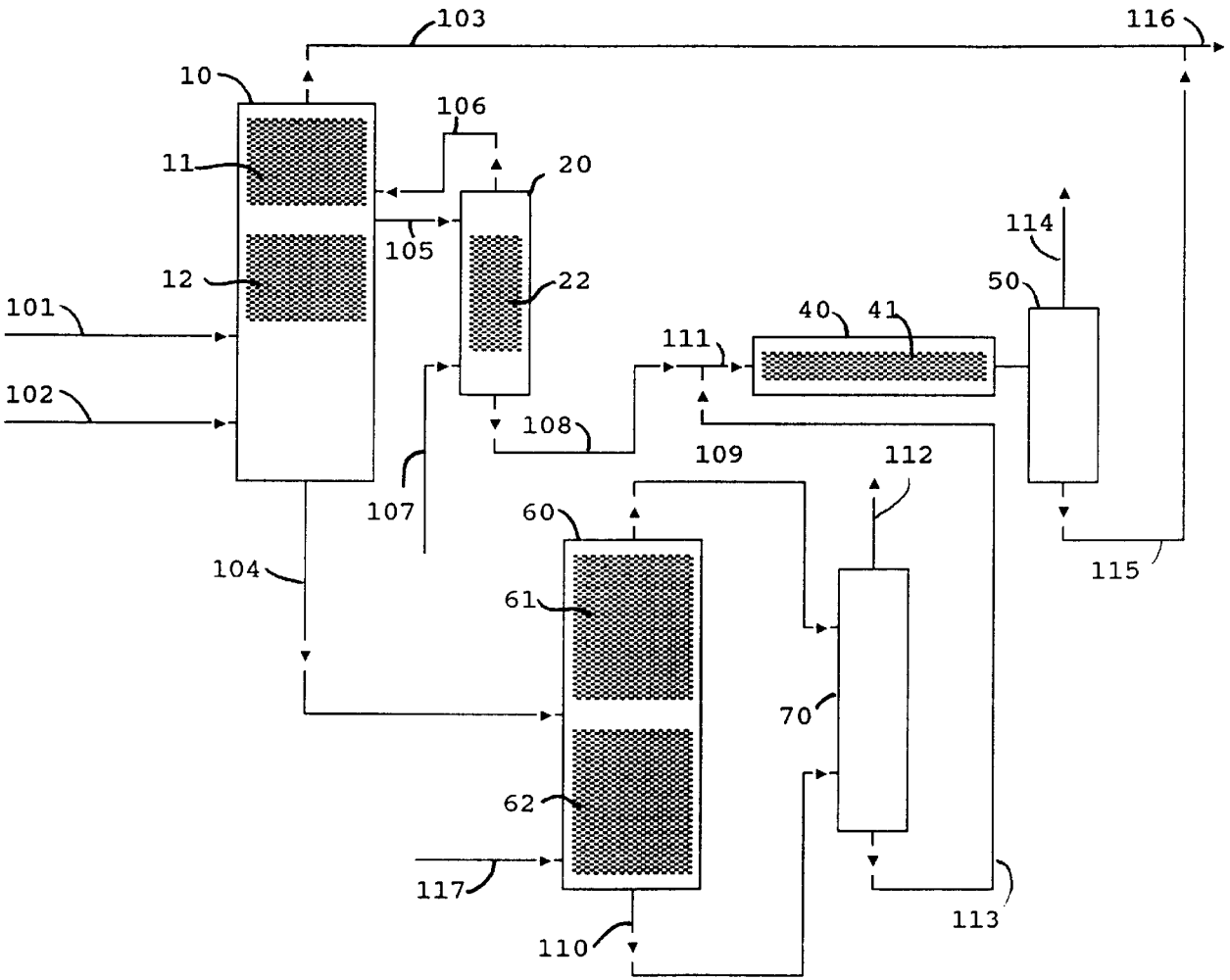
FIGURE

PROCESS FOR SULFUR REDUCTION IN NAPHTHA STREAMS

BACKGROUND OF THE INVENTION

1. Field of the Invention

The present invention relates to a process for concurrently fractionating and hydrotreating a full range naphtha stream. More particularly the full boiling range naphtha stream is subjected to simultaneous thioetherification and splitting into a light boiling range naphtha, a medium boiling range naphtha and a heavy boiling range naphtha. Each boiling range naphtha is treated separately to achieve a combined desired-total sulfur content.

2. Related Information

Petroleum distillate streams contain a variety of organic chemical components. Generally the streams are defined by their boiling ranges which determine the compositions. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

The composition of untreated naphtha as it comes from the crude still, or straight run naphtha, is primarily influenced by the crude source. Naphthas from paraffinic crude sources have more saturated straight chain or cyclic compounds. As a general rule most of the "sweet" (low sulfur) crudes and naphthas are paraffinic. The naphthenic crudes contain more unsaturates and cyclic and polycylic compounds. The higher sulfur content crudes tend to be naphthenic. Treatment of the different straight run naphthas may be slightly different depending upon their composition due to crude source.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha as it comes from the catalytic cracker has a relatively high octane number as a result of the olefinic and aromatic compounds contained therein. In some cases this fraction may contribute as much as half of the gasoline in the refinery pool together with a significant portion of the octane.

Catalytically cracked naphtha gasoline boiling range material currently forms a significant part (≈1/3) of the gasoline product pool in the United States and it provides the largest portion of the sulfur. The sulfur impurities may require removal, usually by hydrotreating, in order to comply with product specifications or to ensure compliance with environmental regulations.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included-in the feed. The following equations illustrate the reactions in a typical HDS unit:

$$RSH+H_2 \rightarrow RH+H_2S \quad (1)$$

$$RCl+H_2 \rightarrow RH+HCl \quad (2)$$

$$RN+2H_2 \rightarrow RH+NH_3 \quad (3)$$

$$ROOH+2H_2 \rightarrow RH+H_2O \quad (4)$$

Typical operating conditions for the HDS reactions are:

| | |
|---|---|
| Temperature, ° F. | 600–780 |
| Pressure, psig | 600–3000 |
| $H_2$ recycle rate, SCF/bbl | 1500–3000 |
| Fresh $H_2$ makeup, SCF/bbl | 700–1000 |

The reaction of organic sulfur compounds in a refinery stream with hydrogen over a catalyst to form $H_2S$ is typically called hydrodesulfurization. Hydrotreating is a broader term which includes saturation of olefins and aromatics and the reaction of organic nitrogen compounds to form ammonia. However hydrodesulfurization is included and is sometimes simply referred to as hydrotreating. After the hydrotreating is complete, the product may be fractionated or simply flashed to release the hydrogen sulfide and collect the now desulfurized naphtha.

In addition to supplying high octane blending components the cracked naphthas are often used as sources of olefins in other processes such as etherifications. The conditions of hydrotreating of the naphtha fraction to remove sulfur will also saturate some of the olefinic compounds in the fraction reducing the octane and causing a loss of source olefins.

Various proposals have been made for removing sulfur while retaining the more desirable olefins. Since the olefins in the cracked naphtha are mainly in the low boiling fraction of these naphthas and the sulfur containing impurities tend to be concentrated in the high boiling fraction the most common solution has been prefractionation prior to hydrotreating. The prefractionation produces a light boiling range naphtha which boils in the range of $C_5$ to about 250° F. and a heavy boiling range naphtha which boils in the range of from about 250–475° F.

The predominant light or lower boiling sulfur compounds are mercaptans while the heavier or higher boiling compounds are thiophenes and other heterocyclic compounds. The separation by fractionation alone will not remove the mercaptans. However, in the past the mercaptans were frequently removed by oxidative processes involving caustic washing. A combination oxidative removal of the mercaptans followed by fractionation and hydrotreating of the heavier fraction is disclosed in U.S. Pat. No. 5,320,742. In the oxidative removal of the mercaptans the mercaptans are converted to the corresponding disulfides.

In addition to treating the lighter portion of the naphtha to remove the mercaptans the lighter fraction traditionally has been used as feed to a catalytic reforming unit to increase the octane number if necessary. Also the lighter fraction may be subjected to further separation to remove the valuable $C_5$ olefins (amylenes) which are useful in preparing ethers.

More recently a new technology has allowed for the simultaneous treatment and fractionation of petroleum products, including naphtha, especially fluid catalytically cracked naphtha (FCC naphtha). See, for example, commonly owned U.S. Pat. Nos. 5,510,568; 5,597,476; 5,779,883; 5,807,477 and 6,083,378.

Full boiling range FCC naphtha has been hydrotreated in a splitter which contains a thioetherification catalyst in the upper portion. Mercaptans in the light fraction react with the diolefins contained therein (thioetherification) to produce higher boiling sulfides which are removed as bottoms along with the heavy (higher boiling) FCC naphtha. Similarly, the light fraction has been treated to saturate dienes. The bottoms are usually subjected to further hydrodesulfurization.

It has now been found that the light FCC naphtha cut in the splitter just below the light fraction also contains mercaptans and a significant amount of thiophenes. The mercaptans in this cut may be removed by the thioetherification. The total sulfur content of the thiophene cut is relatively low and more significantly does not require as severe treatment as the sulfur compounds in the heavy fraction to convert the thiophene to $H_2S$, thus the olefins in the thiophene cut are less likely to be hydrogenated.

It is an advantage of the present invention that the sulfur may be removed from the light olefin portion of the stream to a heavier portion of the stream without any substantial loss of olefins. Substantially all of the sulfur in the heavier portion is converted to $H_2S$ by hydrodesulfurization and easily distilled away from the hydrocarbons. Also, the sulfur in the middle cut will also be lowered.

SUMMARY OF THE INVENTION

Briefly the present invention is process for removal of sulfur from a full boiling range fluid cracked naphtha stream to meet higher standards for sulfur removal, by splitting the light portion of the stream and treating the components of the naphtha feed with the process that preserves the olefinic while most expediently removing the sulfur compounds.

In one embodiment the present invention utilizes a three-way naphtha splitter as a first distillation column reactor to treat the lightest boiling range naphtha to remove the mercaptans contained therein by reaction with diolefins in the naphtha to form sulfides or optionally, the diolefins may be saturated via selective hydrogenation. A sidedraw of a thiophene cut is taken near the bottom of the rectification section of the first distillation column reactor which may be passed directly to a polishing reactor or more preferably fractionated in a second column to return hydrocarbons and/or mercaptans to the first distillation column reactor and more preferably, depending on the constitution of the sidedraw, contacted with a catalyst in the presence of hydrogen to react diolefins and mercaptans or to hydrogenate diolefins. The bottoms from the first distillation column reactor may be fed to a hydrodesulfurization distillation column reactor to remove the remaining organic sulfur compounds and the sulfides produced in the first distillation column by destructive hydrodesulfurization.

The overheads and/or the bottoms from the hydrodesulfurization column are combined with bottoms from the second column and fed to a straight pass hydrogenation reactor (preferably down flow) for polishing reaction to reduce the sulfur content to that desire, i.e., 50 wppm.

Preferably the process comprises the steps of:

(a) contacting hydrogen and a full boiling range naphtha feed containing olefins, diolefins, mercaptans, thiophene and other organic sulfur compounds under conditions of thioetherification with a thioetherification catalyst to:
concurrently:
(i) react a portion of the mercaptans contained within said full boiling range naphtha stream with a portion of the diolefins contained within said full boiling range naphtha stream to produce sulfides: react a portion of the diolefins contained within said full boiling range naphtha stream with a hydrogen to fully or partially saturate said diolefins or a combination thereof and
(ii) separate said full boiling range naphtha stream into at least three fractions by fractional distillation;
(b) removing a fraction comprising light naphtha containing reduced mercaptans, sulfides and other organic sulfur compounds as a first overheads;
(c) removing at least one intermediate stream fraction;
(d) removing a heavy naphtha fraction containing said sulfides and other organic sulfur compounds as a first bottoms;
(e) contacting said first bottoms and hydrogen under conditions to react mercaptans to form $H_2S$ in the presence of a hydrodesulfurization catalyst;
(f) separating said $H_2S$ from said first bottoms product as a vapor to form a liquid product;
(g) combining a portion of at least one said intermediate stream with said liquid product and
(h) contacting said combined streams and hydrogen under (i) hydrodesulfurization conditions with a hydrodesulfurization catalyst wherein a portion of any remaining sulfides and other organic sulfur compounds are reacted with hydrogen to form hydrogen sulfide; (ii) a thioetherification catalyst under thioetherification conditions wherein a portion of any remaining diolefins are selectively hydrogenated or (iii) a combination thereof.

The advantage of this system is that the size and capital of the hydrodesulfurization distillation column reactor are reduced. The level of recombinant mercaptans coming for the hydrodesulfurization distillation column is reduced. Finally there is a potential savings in octane due to the milder treatment of the olefin rich thiophene cut.

As used herein the term "distillation column reactor" means a distillation column which also contains catalyst such that reaction and distillation are going on concurrently in the column. In a preferred embodiment the catalyst is prepared as a distillation structure and serves as both the catalyst and distillation structure.

BRIEF DESCRIPTION OF THE DRAWINGS

The FIGURE is a simplified flow diagram of one embodiment of the invention.

DETAILED DESCRIPTION OF THE INVENTION

In the present invention it is contemplated that the first step, i.e., that of thioetherification and fractionation is carried out by reactive distillation, since that method provides many advantages of economy of operation and equipment and superior results, however the subsequent treatments and described may be carried out by what may be called "straight pass" reactions, as generally representative of the old art or in most instances more preferably by reactive distillation.

The feed to the process comprises a sulfur-containing petroleum fraction which boils in the gasoline boiling range. Feeds of this type include light naphthas having a boiling range of about $C_5$ to 330° F. and full range naphthas having a boiling range of $C_5$ to 420° F. Generally the process is useful on the naphtha boiling range material from catalytic cracker products because they contain the desired olefins and unwanted sulfur compounds. Straight run naphthas have very little olefinic material, and unless the crude source is "sour", very little sulfur.

The sulfur content of the catalytically cracked fractions will depend upon the sulfur content of the feed to the cracker as well as the boiling range of the selected fraction used as feed to the process. Lighter fractions will have lower sulfur contents than higher boiling fractions. The front end of the naphtha contains most of the high octane olefins but relatively little of the sulfur. The sulfur components in the front end are mainly mercaptans and typical of those compounds are: methyl mercaptan (b.p. are mainly mercaptans and typical of those compounds are: methyl mercaptan (b.p. 43° F.), ethyl mercaptan (b.p. 99° F.), n-propyl mercaptan (b.p. 154° F.), iso-propyl mercaptan (b.p. 135–140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.) and 3-mercapto hexane (b.p. 135° F.). Typical sulfur compounds found in the heavier boiling fraction include the heavier mercaptans, thiophenes sulfides and disulfides.

The reaction of these mercaptans with diolefins contained within the naphtha is called thioetherification and the products are higher boiling sulfides. A suitable catalyst for the reaction of the diolefins with the mercaptans is 0.4 wt % Pd on 7 to 14 mesh $Al_2O_3$ (alumina) spheres, supplied by S üd-Chemie, designated as G-68C-1. Typical physical and chemical properties of the catalyst as provided by the manufacturer are as follows:

TABLE I

| | |
|---|---|
| Designation | G-68C-1 |
| Form | Spheres |
| Nominal size | 7 × 12 mesh |
| Pd. wt. % | 0.4 ± 0.03 |
| Support | High purity alumina (99.0–99.5) |

Another catalyst useful for the mercaptan-diolefin reaction is Ni silica/alumina extrudates, supplied by S üd-Chemie, designated as C46-7-03RS. Typical physical and chemical properties of the catalyst as provided by the manufacturer are as follows:

TABLE II

| | |
|---|---|
| Designation | C46-7-03 RS |
| Form | Extrudate |
| Nominal size | 1/16" |
| Ni wt. % | 52 ± 4 |
| Support | Silica/Alumina |

The hydrogen rate to the reactor must be sufficient to maintain the reaction, but kept below that which would cause flooding of the column which is understood to be the "effectuating amount of hydrogen" as that term is used herein. The mole ratio of hydrogen to diolefins and acetylenes in the feed is at least 1.0 to 1.0 and preferably 2.0 to 1.0.

Catalyst which are useful for the hydrodesulfurization reaction include Group VIII metals such as cobalt, nickel, palladium, alone or in combination with other metals such as molybdenum or tungsten on a suitable support which may be alumina, silica-alumina, titania-zirconia or the like. Normally the metals are provided as the oxides of the metals supported on extrudates or spheres and as such are not generally useful as distillation structures.

The catalysts contain components from Group V, VIB, VIII metals of the Periodic Table or mixtures thereof. The use of the distillation system reduces the deactivation and provides for longer runs than the fixed bed hydrogenation units of the prior art. The Group VIII metal provides increased overall average activity. Catalysts containing a Group VIB metal such as molybdenum and a Group VIII such as cobalt or nickel are preferred. Catalysts suitable for the hydrodesulfurization reaction include cobalt-molybdenum, nickel-molybdenum and nickel-tungsten. The metals are generally present as oxides supported on a base such as alumina, silica-alumina or the like. The metals are reduced to the sulfide either in use or prior to use by exposure to sulfur compound containing streams. The catalyst may also catalyze the hydrogenation of the olefins and polyolefins contained within the light cracked naphtha and to a lesser degree the isomerization of some of the mono-olefins. The hydrogenation, especially of the mono-olefins in the lighter fraction may not be desirable.

The properties of a typical hydrodesulfurization catalyst are shown in Table I below.

TABLE III

| | |
|---|---|
| Manufacture | Criterion Catalyst Co. |
| Designation | C-448 |
| Form | Tri-lobe Extrudate |
| Nominal size | 1.2 mm diameter |
| Metal, Wt. % | |
| Cobalt | 2–5% |
| Molybdenum | 5–20% |
| Support | Alumina |

The catalyst typically is in the form of extrudates having a diameter of 1/8, 1/16 or 1/32 inches and an L/D of 1.5 to 10. The catalyst also may be in the form of spheres having the same diameters. They may be directly loaded into standard straight pass fixed bed reactors which include supports and reactant distribution structures. However, in their regular form they form too compact a mass and must then be prepared in the form of a catalytic distillation structure. The catalytic distillation structure must be able to function as catalyst and as mass transfer medium. The catalyst must be suitably supported and spaced within the column to act as a catalytic distillation structure. In a preferred embodiment the catalyst is contained in a woven wire mesh structure as disclosed in U.S. Pat. No. 5,266,546, which is hereby incorporated by reference. More preferably the catalyst is contained in a plurality of wire mesh tubes closed at either end and laid across a sheet of wire mesh fabric such as demister wire. The sheet and tubes are then rolled into a bale for loading into the distillation column reactor. This embodiment is described in U.S. Pat. No. 5,431,890 which is hereby incorporated by reference. Other catalytic distillation structures useful for this purpose are disclosed in U.S. Pat. Nos. 4,731,229, 5,073,236, 5,431,890 and 5,730,843 which are also incorporated by reference.

Reaction conditions for sulfur removal only in a standard straight pass fixed bed reactor are in the range of 500–700° F. at pressures of between 400–1000 psig. Residence times expressed as liquid hourly space velocity are generally typically between 1.0 and 10. The naphtha in the straight pass fixed bed reaction may be in the liquid phase or gaseous phase depending on the temperature and pressure, with total pressure and hydrogen gas rate adjusted to attain hydrogen partial pressures in the 100–700 psia range. The operation of the straight pass fixed bed hydrodesulfurization is otherwise well known in the art.

The conditions suitable for the desulfurization of naphtha in a distillation column reactor are very different from those in a standard trickle bed reactor, especially with regard to total pressure and hydrogen partial pressure. Typical conditions in a reaction distillation zone of a naphtha hydrodesulfurization distillation column reactor are:

| | |
|---|---|
| Temperature | 450–700° F. |
| Total Pressure | 75–300 psig |
| $H_2$ partial pressure | 15–75 psi |
| LHSV of naphtha | about 1–5 |
| $H_2$ rate | 10–1000 SCFB |

The operation of the distillation column reactor results in both a liquid and vapor phase within the distillation reaction zone. A considerable portion of the vapor is hydrogen while a portion is vaporous hydrocarbon from the petroleum fraction. Actual separation may only be a secondary consideration.

Without limiting the scope of the invention it is proposed that the mechanism that produces the effectiveness of the present process is the condensation of a portion of the vapors in the reaction system, which occludes sufficient hydrogen in the condensed liquid to obtain the requisite intimate contact between the hydrogen and the sulfur compounds in the presence of the catalyst to result in their hydrogenation. In particular, sulfur species concentrate in the liquid while the olefins and $H_2S$ concentrate in the vapor allowing for high conversion of the sulfur compounds with low conversion of the olefin species.

The result of the operation of the process in the distillation column reactor is that lower hydrogen partial pressures (and thus lower total pressures) may be used. As in any distillation there is a temperature gradient within the distillation column reactor. The temperature at the lower end of the column contains higher boiling material and thus is at a higher temperature than the upper end of the column. The lower boiling fraction, which contains more easily removable sulfur compounds, is subjected to lower temperatures at the top of the column which provides for greater selectivity, that is, less hydrocracking or saturation of desirable olefinic compounds. The higher boiling portion is subjected to higher temperatures in the lower end of the distillation column reactor to crack open the sulfur containing ring compounds and hydrogenate the sulfur.

It is believed that in the present distillation column reaction is a benefit first, because the reaction is occurring concurrently with distillation, the initial reaction products and other stream components are removed from the reaction zone as quickly as possible reducing the likelihood of side reactions. Second, because all the components are boiling the temperature of reaction is controlled by the boiling point of the mixture at the system pressure. The heat of reaction simply creates more boil up, but no increase in temperature at a given pressure. As a result, a great deal of control over the rate of reaction and distribution of products can be achieved by regulating the system pressure. A further benefit that this reaction may gain from distillation column reactions is the washing effect that the internal reflux provides to the catalyst thereby reducing polymer build up and coking.

Finally, the upward flowing hydrogen acts as a stripping agent to help remove the $H_2S$ which is produced in the distillation reaction zone.

Referring now to the FIGURE a simplified flow diagram in schematic form is shown. Thioetherification and/or selective hydrogenation catalyst(s), preferably thioetherification, in the form of a catalytic distillation structure is loaded into two beds 11 and 12 of the rectification section of a naphtha splitter 10 configured as a distillation column reactor. The naphtha feed is into the distillation column reactor 10 below the lower bed 12 via flow line 101. Hydrogen is fed into the lower part of the column via flow line 102 The light naphtha is boiled up into the catalyst beds 11 and 12 in the rectification section where the mercaptans react with diolefins in the naphtha to form sulfides which are higher boiling and thus are separated out with the heavy naphtha. The light naphtha, now lower in sulfur content is removed as overheads via flow line 103 The preferred operating conditions for the thioetherification reactor are as follows:

| | |
|---|---|
| Pressure | 0–250 psig |
| Temperature | 130–270° F. |
| $H_2$ partial pres. | 0.1–70 psi |
| LHSV | 0.2–10.0 |

The heavy naphtha fraction is taken as bottoms via flow line 104 and is subjected to hydrodesulfurization by the catalyst in beds 61 and 62 within the distillation column reactor 60 Hydrogen is fed for the reaction via flow line 117 An overheads is taken via flow line 109 and a bottoms via flow line 110 Both overheads and bottom from distillation column reactor 60 are fed to a vapor disengaging vessel 70 where the $H_2S$ produced in the reactor 60 is taken out as a gas via flow line 112 along with unreacted $H_2$. The preferred operating conditions and results for the distillation column reactor 60 are as follows:

| | |
|---|---|
| Pressure | 100–300 psig |
| $H_2$ rate | 30–1000 scfh |
| $H_2$ partial pres. | 1–60 psi |
| LHSV | 0.2–5.0 |
| % HDS | 98 |

The liquid product from the vessel 70 is finally fed to a polishing reactor in the form of a standard straight pass fixed bed down flow reactor 40 containing a bed 41 of standard desulfurization catalyst.

A sidedraw from the thioetherification reactor 10 is taken via flow line 105 and fed to a smaller second thioetherification distillation column reactor 20 containing a bed 22 of selective hydrogenation catalyst in the form of a distillation structure. Hydrogen is fed to this reactor via flow line 107 The remaining mercaptans in this fraction are removed with the bottoms in flow line 108 Lighter products are returned to the first distillation reactor 10 as a vapor via flow line 106 The bottoms in flow line 108 are combined with the liquid in flow line 113 and fed to polishing reactor 40 where the final desired sulfur level is achieved. Because the total sulfur content of this sidedraw is relatively low it does not require the full severity of the hydrodesulfurization distillation column reactor 60 The sulfur content of this cut is low enough to be directly treated in the polishing reactor 40

The effluent from the reactor 40 is passed to a second vapor disengaging vessel 50 wherein the $H_2S$ and hydrogen are separated from the product. If necessary, the product may be fractionated to completely remove the $H_2S$. The liquid is removed from the vessel 50 via flow line 115 and then combined with the overheads in flow line 103 for a low sulfur full boiling range naphtha.

Hydrogen is generally recycled back to the reactors. Vents may be sufficient to maintain the $H_2S$ levels low enough for the reaction. However, if desired, the recycle gas may be scrubbed using conventional methods to remove the $H_2S$.

EXAMPLE

In order to isolate this thiophene-range product from the gasoline, the overhead product is treated and to meet the final sulphur specification. The mid-product (thiophene cut) is treated for mercaptan removal, then goes directly to the polishing reactor. The bottoms product from the distillation column reactor goes into the hydrodesulfurization unit where it is subjected to more severe sulfur removal conditions. In this way, each range of the gasoline is given a more appropriate level of desulfurization severity.

A full range gasoline described in Table 1 was tested in the thioetherification distillation column reactor. The results are presented in Table 2.

TABLE 1

Properties of the full range gasoline used for testing.

ASTM D-3710

| | ° F. |
|---|---|
| 10/0 | 84 |
| 10% | 94 |
| 20% | 108 |
| 30% | 147 |
| 40% | 175 |
| 50% | 201 |
| 60% | 230 |
| 70% | 276 |
| 80% | 308 |
| 90% | 350 |
| 95% | 384 |
| Total S | 970 mg/L |
| Bromine No. | 60 |
| Density | .7465 g/cc |
| Total C4's | 0.09 wt. % |
| Total C5's | 20.9 wt. % |
| benzene | 1.12 wt. % |
| Total C6's | 18.8 wt. % |
| | mg/L |
| H2S | 0 |
| dimethyl sulphide | 0 |
| COS | 0 |
| MeSH | 0 |
| EtSH | 14.83 |
| 1- PrSH | 4.59 |
| 2-PrSH | 4.94 |
| thiophene | 53.82 |
| 2-methylthiophene | 60.32 |
| 3-methylthiophene | 83.54 |
| tetrahydrothiophene | 15.11 |
| propylsulphide | 38.9 |
| benzothiophene | 73.06 |
| unknowns | 167.67 |
| heavy S | 99.7 |

TABLE 2

| | |
|---|---|
| Gasoline feed rate (lb/h) | 116 |
| Hydrogen feed rate (scfh) | 3 |
| % of feed recovered overhead | 27.9 |
| % of feed recovered in side product | 13.9 |
| Operating pressure (psig) | 75 |
| Reflux ratio | 3.5 |
| Upper catalyst bed temperature (° F.) | 258 |
| Lower catalyst bed temperature (° F.) | 291 |
| Sulphur in OH product (ppmw) | 58.2 |
| Sulphur in side product (ppmw) | 495 |
| Sulphur in bottom product (ppmw) | 1900 |
| % of olefins taken overhead | 50.1 |
| % of olefins taken in side product | 18.8 |
| % of thiophene taken overhead | 18.7 |
| % of thiophene taken in side product | 79.7 |
| Ethyl mercaptan conversion (%) | 99.5+ |
| Propyl mercaptan conversion (%) | 99.5+ |

The invention claimed is:

1. A process comprising the steps of:

(a) contacting hydrogen and a full boiling range naphtha feed containing olefins, diolefins, mercaptans, thiophene and other organic sulfur compounds under conditions of thioetherification with a thioetherification catalyst to:

concurrently:

(i) react a portion of the mercaptans contained within said full boiling range naphtha stream with a portion of the diolefins contained within said full boiling range naphtha stream to produce sulfides:

react a portion of the diolefins contained within said full boiling range naphtha stream with a hydrogen to fully or partially saturate said diolefins or a combination thereof and (ii) separate said full boiling range naphtha stream into at least three fractions by fractional distillation;

(b) removing a fraction comprising light naphtha containing reduced mercaptans, sulfides and other organic sulfur compounds as a first overheads;

(c) removing at least one intermediate stream fraction;

(d) removing a heavy naphtha fraction containing said sulfides and other organic sulfur compounds as a first bottoms;

(e) contacting said first bottoms and hydrogen under conditions to react mercaptans to form $H_2S$ in the presence of a hydrodesulfurization catalyst;

(f) separating said $H_2S$ from said first bottoms product as a vapor to form a liquid product;

(g) combining a portion of at least one said intermediate stream with said liquid product and (h) contacting said combined streams and hydrogen under (i) hydrodesulfurization conditions with a hydrodesulfurization catalyst wherein a portion of any remaining sulfides and other organic sulfur compounds are reacted with hydrogen to form hydrogen sulfide; (ii). a thioetherification catalyst under thioetherification conditions wherein a portion of any remaining diolefins are selectively hydrogenated or (iii) a combination thereof.

2. A process comprising the steps of:

(a) contacting hydrogen and a full boiling range naphtha feed containing olefins, diolefins, mercaptans, thiophene and other organic sulfur compounds in a bed of thioetherification catalyst under conditions of thioetherification to:

concurrently (i) react a portion of the mercaptans contained within said full boiling range naphtha stream with a portion of the diolefins contained within said full boiling range naphtha stream to produce sulfides and (ii) separate said full boiling range naphtha stream into at least three fractions by fractional distillation;

(b) removing a fraction comprising light naphtha containing reduced mercaptans, sulfides and other organic sulfur compounds as a first overheads;

(c) removing an intermediate stream as a sidedraw containing thiophene, and diolefins, mercaptans or mixtures thereof boiling in the range of thiophene and mercaptans boiling in the range of thiophene;

(d) removing a heavy naphtha containing said sulfides and other organic sulfur compounds as a first bottoms;

(e) contacting said first bottoms and hydrogen with a bed of hydrodesulfurization catalyst under conditions of hydrodesulfurization to:
concurrently;
(i) react a portion of said sulfides and other organic sulfur compounds contained in said first bottoms with hydrogen to produce $H_2S$ and
(ii) splitting said first bottoms into a second overheads and a second bottoms by fractional distillation;

(f) combining said second overheads and second bottoms and separating said $H_2S$ as a vapor from said combined overheads and bottoms as a first liquid product; and (g) combining a portion of said intermediate stream with first liquid product and contacting said combined, intermediate stream and first liquid product and hydrogen with a hydrodesulfurization catalyst under conditions of hydrodesulfurization where substantially all of any remaining sulfides and other organic sulfur compounds are reacted with hydrogen to form hydrogen sulfide.

3. The process according to claim 2 comprising:

(h) contacting said intermediate stream and hydrogen with a thioetherification catalyst under conditions of thioetherification to:
concurrently:
(i) react a portion of the mercaptans contained within said intermediate stream with the diolefins contained with said intermediate stream to form disulfides and
(ii) separate said intermediate stream into a third overheads and third bottoms by fractional distillation;

(i) returning said third overheads to step (a); and (j) combining said third bottoms with said first liquid product and contacting said combined third bottoms and first liquid product and hydrogen with a hydrodesulfurization catalyst under conditions of hydrodesulfurization where portion of any remaining sulfides and other organic sulfur compounds are reacted with hydrogen to form hydrogen sulfide.

4. The process according to claim 2 comprising:

(h) contacting said intermediate stream and hydrogen with a hydrodesulfurization catalyst under conditions of hydrodesulfurization to:
concurrently:
(i) react a portion of the dienes contained within said intermediate stream with the hydrogen and
(ii) separate said intermediate stream into a third overheads and third bottoms by fractional distillation;

(i) returning said third overheads to step (a); and (j) combining said third bottoms with said first liquid product and contacting said combined third bottoms and first liquid product and hydrogen with a hydrodesulfurization catalyst under hydrodesulfurization conditions where a portion of any remaining sulfides and other organic sulfur compounds are reacted with hydrogen to form hydrogen sulfide.

5. The process according to claim 2 wherein an effluent from step (g) is fractionated to remove the $H_2S$ as a vapor to form a second liquid product.

6. The process according to claim 5 wherein said second liquid product is combined with said first, overheads to form a full boiling range naphtha which contains less total sulfur content than said full boiling range naphtha feed.

7. The process according to claim 2 wherein said thioetherification catalyst comprises palladium supported on an alumina base.

8. The process according to claim 2 wherein said hydrodesulfurization catalyst comprises the oxides of a Group VIB or Group VIII supported on an alumina base.

9. The process according to claim 8 wherein said catalyst comprises the oxides of cobalt and molybdenum supported on an alumina base.

10. The process according to claim 8 wherein said catalyst comprises the oxides of nickel and molybdenum supported on an alumina base.

11. The process according to claim 8 wherein said catalyst comprises the oxides of nickel and tungsten supported on an alumina base.

12. The process according to claim 8 wherein said oxides are converted to sulfides prior to feeding said full boiling range naphtha feed.

13. A process comprising the steps of:

(a) contacting hydrogen and a full boiling range naphtha feed containing olefins, diolefins, mercaptans, thiophene and other organic sulfur compounds under conditions of thioetherification with a thioetherification catalyst to:
concurrently:
(i) react a portion of the diolefins contained within said full boiling range naphtha stream with a hydrogen to fully or partially saturate said diolefins and
(ii) separate said full boiling range naphtha stream into at least three fractions by fractional distillation;

(b) removing a first fraction comprising light naphtha containing reduced mercaptans, sulfides and other organic sulfur compounds as a first overheads;

(c) removing at least one intermediate stream;

(d) removing a heavy naphtha containing said sulfides and other organic sulfur compounds as a first bottoms;

(e) contacting said first bottoms and hydrogen under conditions to react mercaptans to form $H_2S$ in the presence of a hydrodesulfurization catalyst;

(f) separating said $H_2S$ from said first bottoms product as a vapor to form a first liquid product;

(g) combining a portion of at least one said intermediate stream with said first liquid product and (h) contacting said combined streams and hydrogen under (i) hydrodesulfurization conditions with a hydrodesulfurization catalyst wherein a portion of any remaining sulfides and other organic sulfur compounds are reacted with hydrogen to form hydrogen sulfide; (ii) a thioetherification catalyst under thioetherification conditions wherein a portion of any remaining diolefins are selectively hydrogenated or (iii) a combination thereof.

14. The process according to claim 13 wherein step (h) comprises:

hydrodesulfurization conditions with a hydrodesulfurization catalyst wherein a portion of any remaining sulfides and other organic sulfur compounds are reacted with hydrogen to form hydrogen sulfide.

15. The process according to claim 13 wherein step (h) comprises:

thioetherification conditions with a thioetherification wherein a portion of any remaining diolefins are selectively hydrogenated.

16. The process according to claim 13 wherein step (h) comprises a combination thereof.

17. A process for removal of sulfur from a full boiling range fluid cracked naphtha stream comprising the steps of:

(a) feeding hydrogen and a full boiling range naphtha feed containing olefins, diolefins, mercaptans, thiophene and other organic sulfur compounds to a first distillation column reactor containing a bed of thioetherification catalyst;

(b) concurrently in said first distillation column reactor
  (i) reacting a portion of the mercaptans contained within said full boiling range naphtha stream with a portion of the diolefins contained within said full boiling range naphtha stream to produce sulfides and
  (ii) separating said full boiling range naphtha stream into three fractions by fractional distillation;

(c) removing a first overheads from said first distillation column reactor comprising light naphtha containing reduced amounts of mercaptans, sulfides or other organic sulfur compounds;

(d) removing an intermediate naphtha as a sidedraw from said distillation column reactor containing thiophene, diolefins boiling in the range of thiophene and mercaptans boiling in the range of thiophene;

(e) removing a heavy naphtha from said first distillation column reactor containing said sulfides and other organic sulfur compounds as a first bottoms;

(f) feeding said first bottoms and hydrogen to a second distillation column reactor containing a bed of hydrodesulfurization catalyst;

(g) concurrently in said second distillation column reactor;
  (i) reacting a portion of said sulfides and other organic sulfur compounds with hydrogen to produce $H_2S$ and
  (ii) splitting said bottoms into a second overheads and a second bottoms by fractional distillation column reactor;

(h) combining said second overheads and bottoms and separating said $H_2S$ as a vapor from said combined overheads and bottoms as a first liquid product;

(i) feeding said intermediate stream and hydrogen to a third distillation column reactor containing a thioetherification catalyst;

(j) concurrently in said third distillation column reactor:
  (i) reacting a portion of the mercaptans contained within said intermediate stream with the diolefins contained with said intermediate stream to form disulfides and
  (ii) separating said intermediate stream into a third overheads and third bottoms by fractional distillation;

(k) returning said third overheads to said first distillation column reactor;

(l) combining said third bottoms with first liquid product and feeding said combined third bottoms and first liquid product and hydrogen to a straight pass fixed bed reactor containing a hydrodesulfurization catalyst where a portion of any remaining sulfides and other organic sulfur compounds are reacted with hydrogen to form hydrogen sulfide;

(m) feeding the effluent from said straight pass fixed bed reactor to a vessel wherein the $H_2S$ is removed as a vapor to form a second liquid product; and (n) combining said second liquid product with said first overheads to form a full boiling range naphtha which contains less total sulfur content than said full boiling range naphtha feed.

18. A process for removal of sulfur from a full boiling range fluid cracked naphtha stream comprising the steps of:

(a) contacting hydrogen and a full boiling range naphtha feed containing olefins, diolefins, mercaptans, thiophene and other organic sulfur compounds under conditions of thioetherification with a thioetherification catalyst to:
  concurrently:
    (i) reacting a portion of the mercaptans contained within said full boiling range naphtha stream with a portion of the diolefins contained within said full boiling range naphtha stream to produce sulfides and
    (ii) separating said full boiling range naphtha stream into at least three fractions by fractional distillation;

(b) removing a first fraction comprising light naphtha containing reduced mercaptans, sulfides and other organic sulfur compounds as a first overheads;

(c) removing at least one intermediate stream;

(d) removing a heavy naphtha containing said sulfides and other organic sulfur compounds as a first bottoms;

(e) contacting said first bottoms and hydrogen under conditions to react mercaptans to form $H_2S$ in the presence of a hydrodesulfurization catalyst;

(f) separating said $H_2S$ from said first bottoms product as a vapor to form a liquid product;

(g) combining a portion of at least one said intermediate stream with said liquid product and (h) contacting said combined streams and hydrogen under hydrodesulfurization conditions with a hydrodesulfurization catalyst wherein a portion of any remaining sulfides and other organic sulfur compounds are reacted with hydrogen to form hydrogen sulfide.

* * * * *